United States Patent [19]

Coyle et al.

[11] Patent Number: 4,978,464

[45] Date of Patent: Dec. 18, 1990

[54] MULTI-FUNCTION ADDITIVE FOR LUBRICATING OILS

[75] Inventors: Catherine L. Coyle, Mendham, N.J.; Thomas R. Halbert, Baton Rouge, La.; Edward I. Stiefel, Bridgewater, N.J.

[73] Assignee: Exxon Research and Engineering Company, Florham Park, N.J.

[21] Appl. No.: 404,143

[22] Filed: Sep. 7, 1989

[51] Int. Cl.[5] ..... C10M 139/00

[52] U.S. Cl. ..... 252/42.7; 252/46.4; 252/46.6; 252/400.21; 252/400.54

[58] Field of Search ..... 252/49.7, 49.8, 400.54, 252/400.21, 46.6, 42.7, 46.4

[56] References Cited

U.S. PATENT DOCUMENTS

| | | | |
|---|---|---|---|
| 3,356,702 | 12/1967 | Farmer | 252/400.54 |
| 3,419,589 | 12/1968 | Larson | 252/400.54 |
| 3,509,051 | 4/1970 | Farmer | 252/400.54 |
| 3,840,463 | 10/1974 | Froeschmann | 252/42.7 |
| 4,178,258 | 12/1979 | Papay | 252/32.7 E |
| 4,259,254 | 3/1981 | Bridger | 252/42.7 |
| 4,789,492 | 12/1988 | Katsumata et al. | 252/42.7 |
| 4,832,867 | 5/1989 | Seiki et al. | 252/42.7 |

*Primary Examiner*—Olik Chaudhuri
*Assistant Examiner*—E. McAVOY
*Attorney, Agent, or Firm*—Joseph J. Dvorak

[57] ABSTRACT

A lubricating oil composition is provided which comprises a major amount of an oil of lubricating viscosity and a minor amount of an additive having the formula $Mo_4S_4L_6$ in which L is a ligand selected from dithiocarbamates, dithiophosphates, dithiophosphinates, thioxanthates, and mixtures thereof and in which the ligands, L, have organo groups having a sufficient number of carbon atoms to render the additive soluble in the oil. In general, the organo groups of the ligands, L, will be the same, although they may be different and they preferably are selected from alkyl, aryl, substituted aryl and ether groups. For example, when L is a dialkyldithiocarbamate or a dialkyldithiophosphate, the alkyl groups will have from about 1 to 30 carbon atoms.

16 Claims, No Drawings

MULTI-FUNCTION ADDITIVE FOR LUBRICATING OILS

FIELD OF THE INVENTION

The present invention is concerned with improved lubricating compositions. Indeed, the present invention relates to lubricant compositions containing an additive comprising a thiocubane compound of molybdenum and sulfur.

BACKGROUND OF THE INVENTION

Molybdenum disulfide is a known lubricant additive. Unfortunately, it has certain known disadvantages which are associated with the fact that it is insoluble in lubricating oils. Therefore, oil-soluble molybdenum sulfide containing compounds have been proposed and investigated as lubricant additives. For example, in U.S. Pat. No. 2,951,040 an oil soluble molybdic xanthate is disclosed as being useful in lubricating compositions. Apparently, the molybdic xanthate decomposes under conditions of use to form an oil insoluble solid molybdenum sulfide on the metal surfaces being lubricated.

U.S. Pat. No. 3,419,589 discloses the use of certain "sulfurized" molybdenum (IV) dithiocarbamates as lubricant additives. These additives are described as being oil soluble or at least capable of being easily suspended in oils.

U.S. Pat. No. 3,840,463 discloses the use of certain metal dithiocarbamates or dithiophosphates in combination with metal-free additives containing sulfur and phosphorous.

The foregoing patents are listed as representative of the very many known molybdenum and sulfur containing lubricant additives.

As is known in the art, some lubricant additives function as antiwear agents, some as antioxidants, some as antifriction agents, and some as extreme pressure agents. Indeed, some additives may satisfy more than one of these functions. For example, metal dithiophosphates represent a class of additives which are known to exhibit antioxidant and antiwear properties. The most commonly used additives in this class are the zinc dialkyldithiophosphates. These compounds provide excellent oxidation resistance and exhibit superior antiwear properties. Unfortunately, they do not have the most desirable lubricity. Therefore, lubricating compositions containing these zinc compounds also require the inclusion of antifriction agents. This leads to other problems in formulating effective lubricant compositions.

Additionally, extreme care must be exercised in combining various additives to assure both compatibility and effectiveness. For example, some antifriction agents affect the metal surfaces differently than antiwear agents. If each type of additive is present in a lubricant composition each may compete for the surface of the metal parts which are subject to lubrication. This can lead to a lubricant that is less effective than expected based on the properties of the individual additive components.

Thus, there remains a need for improved lubricating oil additives that can be used with standard lubricating oils and that are compatible with other conventional lubricant additives.

SUMMARY OF THE INVENTION

In accordance with this invention, there is provided a lubricating composition comprising a major amount of an oil of lubricating viscosity and a minor amount of an additive having the formula $Mo_4S_4L_6$ in which L is a ligand selected from dithiocarbamates, dithiophosphates, dithiophosphinates, thioxanthates, and mixtures thereof, and in which the ligands, L, have organo groups having a sufficient number of carbon atoms to render the additive soluble in the oil. In general, the organo groups of the ligands, L, will be the same, although they may be different and they preferably are selected from alkyl, aryl, substituted aryl and ether groups. For example, when L is a dialkyldithiocarbamate or a dialkyldithiophosphate, the alkyl groups will have from about 1 to 30 carbon atoms.

The amount of additive will range from about 0.01 to about 10 weight percent based on the weight of the oil, and preferably, will range from about 0.1 to about 1.0 weight percent.

The lubricant compositions according to this invention have excellent antiwear, antioxidant and friction reducing properties. The lubricant compositions of the present invention are also compatible with other standard additives used in formulating commercial lubricating compositions.

DETAILED DESCRIPTION OF THE INVENTION

The lubricant compositions of the present invention include a major amount of oil of lubricating viscosity. This oil may be selected from naturally occurring mineral oils or from synthetic oils. The oils may range in viscosity from light distillate mineral oils to heavy lubricating oils, such as gas engine oil, mineral lubricating oil, motor vehicle oil, and heavy duty diesel oil. In general, the viscosity of the oil will range from about 5 centistokes to about 26 centistokes and especially in the range of 10 centistokes to 18 centistokes at 100° C.

The lubricant composition of the present invention includes a minor amount of an additive having the formula $Mo_4S_4L_6$ in which L is a ligand selected from dithiocarbamates, dithiophosphates, dithiophosphinates, thioxanthates, and mixtures thereof and wherein the organo groups in the ligands, L, may be the same or different, and preferably are the same and are selected from alkyl, aryl, substituted aryl and ether groups. Importantly, the organo groups of the ligands, L, have a sufficient number of carbon atoms to render the additive soluble in the oil. For example, the number of carbon atoms in the alkyl groups will generally range between about 1 to 30 and preferably between 4 to 20. Indeed, when L is a dialkyldithiocarbamate, the number of carbon atoms in the alkyl groups of the ligand will be greater than 4 and preferably between about 8 to about 12.

The dithiocarbamate containing additives of the present invention can be prepared by reacting molybdenum hexacarbonyl, $Mo(CO)_6$, with a disulfide of the dithiocarbamate at temperatures ranging from about room temperature to about 100° C. For example, $Mo(CO)_6$ can be refluxed in toluene for times ranging between 1 to 100 hours. The reaction time and temperature will depend upon the disulfide selected and solvent used for carrying out the reaction. The resulting product can be isolated from solution, e.g., by removal of the solvent under vacuum. The major molybdenum containing species in the reaction product has a tetrameric thiocubane structure with six bidentate dithiocarbamate ligands.

A similar procedure can be used for preparing the diorganodithiophosphates. For example, $Mo(CO)_6$ can be reacted with the disulfide of a diorganodithiophosphate to provide a molybdenum sulfide compound having a tetrameric thiocubane structure and six bidentate diorganodithiophosphate ligands.

The thioxanthate containing additives are prepared by a similar procedure using $Mo(CO)_6$ and the disulfide of the ligand.

In general, the additives prepared as outlined above can be purified by well known techniques such as recrystallization and the like; however, it is not necessary to purify the additives. Crude mixtures that contain substantial amounts of the additive have been found to be effective.

As was indicated previously, the solubility of the additive depends upon the number of carbon atoms in the ligands. In the practice of the present invention the ligand source chosen for reaction with the $Mo(CO)_6$ will be one which will provide a ligand in the molybdenum thiocubane additive, $Mo_4S_4(L)_n$, that has a sufficient number of carbon atoms to render the additives soluble in the oil component of the lubricating composition.

The above described $Mo_4S_4L_6$ compounds are effective as additives in lubricating compositions when they are used in amounts ranging from about 0.01 to 10 weight percent, based on the weight of lubricating oil and preferably at concentrations ranging from about 0.1 to 1.0 weight percent.

Concentrates of the additive of the present invention in a suitable diluent hydrocarbon carrier provide a convenient means of handling the additives before their use. Aromatic hydrocarbons, especially toluene and xylene, are examples of suitable hydrocarbon diluents for additive concentrates. These concentrates may contain about 1 to about 90 weight percent of the additive based on the weight of diluent, although it is preferred to maintain the additive concentration between about 20 and 70 weight percent.

If desired, other known lubricant additives can be used for blending in the lubricant composition of this invention. These include: ashless dispersants, detergents, pour point depressants, viscosity improvers, and the like. These can be combined in proportions known in the art.

The invention will be more fully understood by reference to the following examples illustrating various modifications of the invention which should not be construed as limiting the scope thereof.

EXAMPLE 1

Preparation of $Mo_4S_4[(C_2H_5)_2NCS_2]_6$ 0.02 moles (5.90 g) of tetraethylthiuram disulfide were dissolved in 12 mls of toluene/3 mls heptane. The solution was degassed and added dropwise via cannula to a solution of 0.01 moles (2.64 g) of molybdenum hexacarbonyl in 10 mls degassed toluene. The solution was heated to reflux at 115° C. for 6 hours, during which time the solution darkened to a purple color. Upon cooling to 0° C., a dark solid precipitated. The purple solid was recrystallized from $CH_2Cl_2/Et_2O$. The yield was approximately 60%.

EXAMPLE 2

Preparation of $Mo_4S_4[(C_8H_{17})_2NCS_2]_6$ 0.067 moles (42.48 g) of tetraoctylthiuram disulfide were dissolved in 80 mls of toluene and degassed. This solution was added dropwise via cannula to 0.038 moles (10.12 g) of molybdenum hexacarbonyl in 80 mls degassed toluene. The solution was heated to reflux at 115° C. for seven days, during which time the solution darkened to a purple color. The solution was evacuated to dryness and the pure product separated on a silica get column eluted with methylene chloride. The product was the first fraction collected and was recrystallized from $CH_2Cl_2$/hexane.

EXAMPLE 3

Preparation of $Mo_4S_4[(C_2H_5O)_2PS_2]_6$ 0.1 moles of molybdenum hexacarbonyl was placed in 30 mls of toluene and degassed. 0.02 moles diethyldithiophosphate disulfide, $(EtO_2PS_2)_2$, dissolved in 30 mls toluene was degassed and added to the molybdenum hexacarbonyl. The mixture was refluxed at 110° C. for six hours. The solution was evacuated to dryness. The pure complex was separated on a silica gel column eluted with $CH_2Cl_2$. The second fraction off the column was isolated and recrystallized with $CH_2Cl_2$/hexane to give approximately 20% yield.

EXAMPLE 4

Preparation of $Mo_4S_4(C_{12}H_{25}SCS_2)_6$ 6.0 g of $(C_{12}H_{25}SCS_2)_2$ and 1.3 g of molybdenum hexacarbonyl were dissolved in 50 mls toluene and 15 mls hexane. The solution was degassed and heated. The complex was recrystallized from hexane/acetone to give approximately 11% yield.

EXAMPLES 5 to 7

In these Examples, the additives of the invention were evaluated for wear protection using the Four Ball Wear Test procedure (ASTM Test D2266). In Example 5, the samples tested consisted of Solvent 150 Neutral (S150N) lubricating oil and 0.5 weight percent of the additive prepared by the method of Example 4. In Example 6, the sample consisted of S150N and 1 weight percent of the additive prepared by the method of Example 4. In Example 7, the sample consisted of S150N and 1 weight percent of the additive prepared by Example 2. The results are given in Table I.

TABLE I

| Test Run | Additive | Wt %, Additive | Four Ball Wear Volume $MM^3 \times 10^4$ |
|---|---|---|---|
| Ex. 5 | $Mo_4S_4(C_{12}H_{25}SCS_2)_6$ | .5 | 6 |
| Ex. 6 | $Mo_4S_4(C_{12}H_{25}SCS_2)_6$ | 1.0 | 8 |
| Ex. 7 | $Mo_4S_4[(C_8H_{17})_2NCS_2]_6$ | 0.5 | 16 |
| Comp. Ex. 8 | None | None | 540 |

COMPARATIVE EXAMPLE 8

For comparative purposes, the Four Ball Wear Test was conducted using only Solvent 150 Neutral (S150N). The results are shown in Table I.

EXAMPLE 9

In this Example, 0.5 weight percent of an additive prepared by the method of Example 2 was mixed in a 10W30 motor oil of commercial formulation, except the zinc dialkyldithiophosphate was lower to provide 0.08% P. The mixture was subjected to the Four Ball Wear Test (ASTM Test D2266). The results are shown in Table II.

TABLE II

| Test Run | Additive | Wt %, Additive | Four Ball Wear Volume $MM^3 \times 10^4$ |
|---|---|---|---|
| Ex. 9 | $MoS_4[(C_8H_{17})_2NCS_2]_6$ | .5 | 15 |

EXAMPLE 10

This Example illustrates the friction reducing properties of $Mo_4S_4(C_{12}H_{25}SCS_2)_6$.

The friction measurements were performed in a ball on cylinder friction tester. This test employs a 12.5 mm diameter stationary ball and a rotating cylinder 43.9 mm in diameter. Both components were made fron ANSI 52100 steel. The steel balls were used in the heat treated condition with a Vickers hardness of 840, the cylinders used in the normalized condition with a Vickers hardness of 215.

The cylinder rotates inside a cup containing sufficient quantity of lubricant such that 2 mm of the cylinder bottom is submerged. The lubricant is carried to the ball contact by the rotation of the cylinder.

A normal force of 9.8N was applied to the ball through dead weights, the cylinder rotated at 0.25 RPM to ensure that boundary lubricating conditions prevailed. The friction force was continuously monitored through a load transducer by measuring the tangential force on the ball. Friction coefficients attain steady state values after 7 to 10 turns of the cylinder.

The sample tested consisted of 0.75 weight percent of the additive in S150N. The results are shown in Table III.

TABLE III

| Test Run | BOC Friction Coefficient |
|---|---|
| Ex. 10 | 0.087 |
| Comp. Ex. 11 | 0.3 |

COMPARATIVE EXAMPLE 11

For comparative purposes, the ball on cylinder test was conducted with $S_{150}N$ in the absence of any additive. The results are shown in Table III.

Examples 12 and 13

Differential scanning colorimetry (DSC) tests were conducted using two different samples. In Example 12, the sample consisted of S150N and 0.5 weight percent of the additive $Mo_4S_4[(C_8H_{17})_2NCS_2]_6$. In Example 13, the sample consisted of a 10W30 motor oil of commercial formulation, except the zinc dialkyldithiophosphate was lower to provide 0.08% P and 0.5 weight percent of the additive. In this DSC test, a sample of the oil is heated in air at a programmed rate, e.g., 5° C./minute, and the rise in sample temperature relative to an inert reference is measured. The temperature at which an exothermic reaction occurs or the oxidation onset temperature is a measure of the oxidative stability of the sample. The results of these tests are also shown in Table IV.

TABLE IV

| Test Run | DSC, °C. |
|---|---|
| Ex. 12 | 276° |
| Ex. 13 | 263° |
| Comp. Ex. 14 | 212° |

COMPARATIVE EXAMPLE 14

The DSC test was performed with $S_{150}N$ for comparative purposes. The results are shown in Table IV.

What is claimed is:

1. A lubricating composition comprising: a major amount of an oil of lubricating viscosity; and, a minor amount of an additive having the formula $Mo_4S_4L_6$ wherein L is an organo group selected from dithiocarbamates, dithiophosphates, dithiophosphinates, thioxanthates, and mixtures thereof and wherein the organo group has a sufficient number of carbon atoms to render the additive soluble in the oil.

2. The composition of claim 1 wherein the amount of the additive is in the range of from about 0.01 to about 10 weight percent based on the weight of oil.

3. The composition of claim 2 wherein the organo groups are selected from alkyl, aryl, substituted aryl and ether groups.

4. The composition of claim 3 wherein the organo groups are alkyl groups and the number of carbon atoms in the alkyl groups are in the range of from about 1 to 30, provided that when L is a dithiocarbamate, the number of carbon atoms in the alkyl group is greater than 4.

5. The composition of claim 4 wherein the number of carbon atoms is in the range of about 4 to about 20.

6. The composition of claim 2 wherein L is a dithiophosphate.

7. The composition of claim 2 wherein L is a thioxanthate.

8. The composition of claim 2 wherein L is a dithiophosphinate.

9. A lubricating composition comprising: a major amount of an oil selected from natural and synthetic oils having viscosities in the range of from about 5 to about 26 centistokes at 100° C., and from about 0.01 to about 10 weight percent of an additive having the formula $Mo_4S_4L_6$, wherein L is an organo group selected from dithiocarbamates, dithiophosphates, dithiophosphinates, thioxanthates, and mixtures thereof and wherein the organo group has from about 1 to about 30 carbon atoms and when the ligand, L, is a dithiocarbamate having alkyl organo groups, the alkyl groups have greater than about 4 carbon atoms.

10. The composition of claim 9 wherein the additive is present in an amount ranging from about 0.1 to about 1.0 weight percent.

11. The composition of claim 10 wherein L is a dithiocarbamate.

12. The composition of claim 10 wherein L is dithiophosphate.

13. The composition of claim 10 wherein L is a thioxanthate.

14. The composition of claim 10 wherein L is a dithiophosphate.

15. An additive concentrate for blending with lubricating oils to provide a lubricating composition having antiwear, antioxidant and friction reducing properties comprising: a hydrocarbon diluent and from about 1 to about 90 weight percent of an additive, based on the weight of diluent, the additive having the formula $Mo_4S_4L_6$ wherein L is an organo group selected from dithiocarbamates, dithiophosphates, dithiophosphinates, thioxanthates, and mixtures thereof and wherein the organo group has from about 1 to about 30 carbon atoms and when the organo group is a dithiocarbamate having alkyl organo groups, the alkyl groups have greater than about 4 carbon atoms.

16. The concentrate of claim 15 wherein the diluent is an aromatic hydrocarbon and the additive ranges between about 20 to about 70 weight percent, based on the weight of diluent.

* * * * *